US008113885B2

(12) United States Patent
Masucci et al.

(10) Patent No.: US 8,113,885 B2
(45) Date of Patent: Feb. 14, 2012

(54) PORTABLE ASSEMBLY HAVING A SUBSCRIBER IDENTIFICATION MODULE

(75) Inventors: Christopher M. Masucci, Des Moines, IA (US); Kenneth C. Clark, Ankeny, IA (US); David M. Thompson, Hope, ND (US); Michael A. Hajicek, West Fargo, ND (US); Todd A. Braun, Fargo, ND (US); Christopher J. Schmit, Fargo, ND (US)

(73) Assignee: Deere & Company, Moline, IL (US)

( * ) Notice: Subject to any disclaimer, the term of this patent is extended or adjusted under 35 U.S.C. 154(b) by 256 days.

(21) Appl. No.: 12/541,438

(22) Filed: Aug. 14, 2009

(65) Prior Publication Data

US 2010/0265667 A1 Oct. 21, 2010

Related U.S. Application Data

(63) Continuation-in-part of application No. 12/425,497, filed on Apr. 17, 2009.

(51) Int. Cl.
*H01R 9/09* (2006.01)

(52) U.S. Cl. ..... 439/620.22

(58) Field of Classification Search ..... 439/620.22, 439/620.21

See application file for complete search history.

(56) References Cited

U.S. PATENT DOCUMENTS

| | | | | |
|---|---|---|---|---|
| 4,932,885 | A | 6/1990 | Scholz | |
| 6,175,517 | B1 | 1/2001 | Jigour et al. | |
| 6,431,902 | B1 | 8/2002 | Yeh | |
| 6,808,396 | B2 | 10/2004 | Kawaguchi et al. | |
| 6,816,386 | B2 | 11/2004 | Oguchi et al. | |
| 6,902,435 | B1 | 6/2005 | Cheng | |
| 6,976,879 | B2 | 12/2005 | Shishikura et al. | |
| 7,006,349 | B2 | 2/2006 | Nuovo et al. | |
| 7,114,659 | B2 | 10/2006 | Harari et al. | |
| 7,118,419 | B1 | 10/2006 | Lee | |
| 7,341,198 | B2 | 3/2008 | Nishizawa et al. | |
| 7,448,914 | B2 | 11/2008 | Calvas et al. | |
| 7,510,444 | B2 | 3/2009 | Chang et al. | |
| 7,789,691 | B2 | 9/2010 | Li et al. | |
| 2002/0055291 | A1 | 5/2002 | Maiterth et al. | |
| 2003/0186587 | A1 * | 10/2003 | Kao et al. | 439/620 |
| 2005/0108571 | A1 | 5/2005 | Lu et al. | |
| 2005/0245136 | A1 | 11/2005 | Yin et al. | |
| 2006/0291483 | A1 | 12/2006 | Sela | |
| 2007/0127220 | A1 | 6/2007 | Lippert et al. | |
| 2009/0068893 | A1 * | 3/2009 | Busse et al. | 439/620.22 |
| 2009/0069048 | A1 | 3/2009 | Yang | |
| 2009/0124126 | A1 | 5/2009 | Cho et al. | |
| 2009/0253301 | A1 * | 10/2009 | Chang et al. | 439/620.22 |

FOREIGN PATENT DOCUMENTS

| | | |
|---|---|---|
| EP | 0965937 | 12/1999 |
| EP | 1602058 | 12/2005 |

* cited by examiner

*Primary Examiner* — Gary F. Paumen

(57) ABSTRACT

An electrical assembly comprises a housing, where the housing has an inner housing and a removable outer housing removably connected to the inner housing. A first connector portion is secured to the inner housing. The first connector portion comprises a dielectric body and connector terminals. A subscriber identification module is supported by the inner housing. The subscriber identification module has device terminals. A group of conductors or a conductor assembly supports an electrical connection of the connector terminals to the device terminals. A holder retains the subscriber identification module with respect to the inner housing.

20 Claims, 4 Drawing Sheets

FIG. 2D
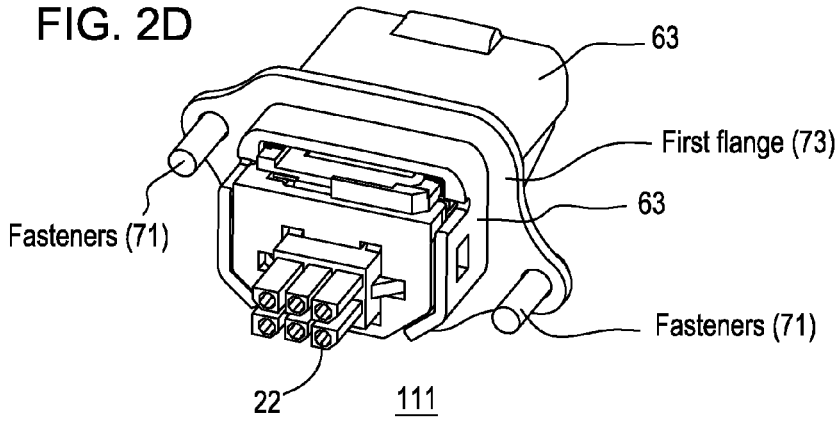
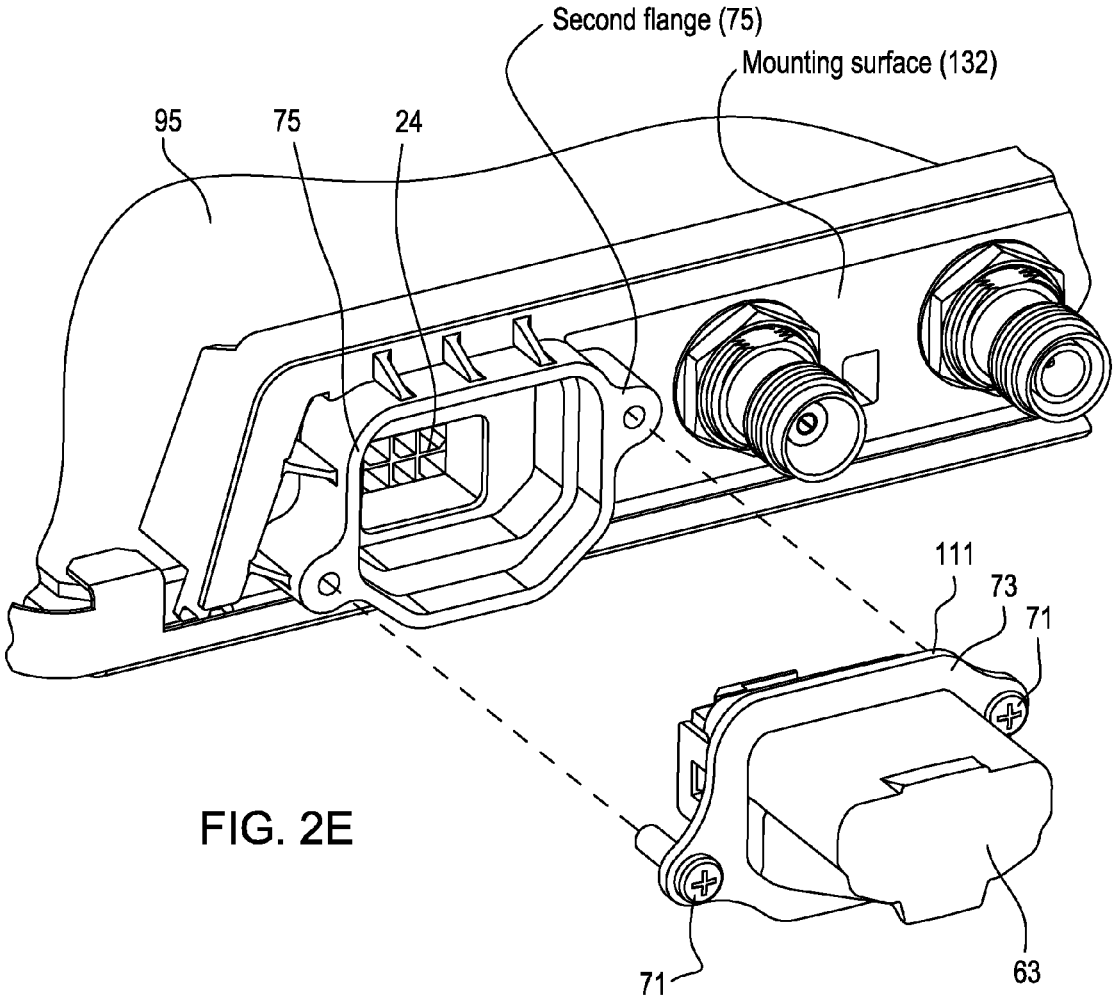
FIG. 2E

PORTABLE ASSEMBLY HAVING A SUBSCRIBER IDENTIFICATION MODULE

CROSS REFERENCE TO RELATED-APPLICATION

This is a continuation-in-part of U.S. application Ser. No. 12/425,497, filed Apr. 17, 2009.

FIELD OF THE INVENTION

This invention relates to a portable assembly having a subscriber identification module.

BACKGROUND OF THE INVENTION

Subscriber identification modules are used in wireless transceivers to assign unique identifiers for each subscriber or user of the wireless transceiver. Further, the subscriber identification module may be associated with a network service provider or a wireless access provider or the level of service available for a particular subscriber. Accordingly, there is need for a portable assembly having a subscriber identification module for reliably adding a subscriber identification module to a wireless device or transceiver, consistent with resistance to shock, vibration, and thermal stress.

SUMMARY OF THE INVENTION

In accordance with one embodiment, an electrical assembly (e.g., an electrical connector assembly) comprises a housing, where the housing has an inner housing and a removable outer housing removably connected to the inner housing. A first connector portion is secured to the inner housing. The first connector portion comprises a dielectric body and connector terminals. A subscriber identification module is supported by the inner housing. The subscriber identification module has device terminals. A group of conductors or a conductor assembly supports the electrical connection of the connector terminals to the device terminals. A holder retains the subscriber identification module with respect to the inner housing.

BRIEF DESCRIPTION OF THE DRAWINGS

FIG. 2D is a perspective view of the second embodiment of an assembly in accordance with FIG. 2A.

FIG. 2E is an exploded perspective view of the second embodiment of the assembly in accordance with FIG. 2A.

DESCRIPTION OF THE PREFERRED EMBODIMENT

Figure 1A:
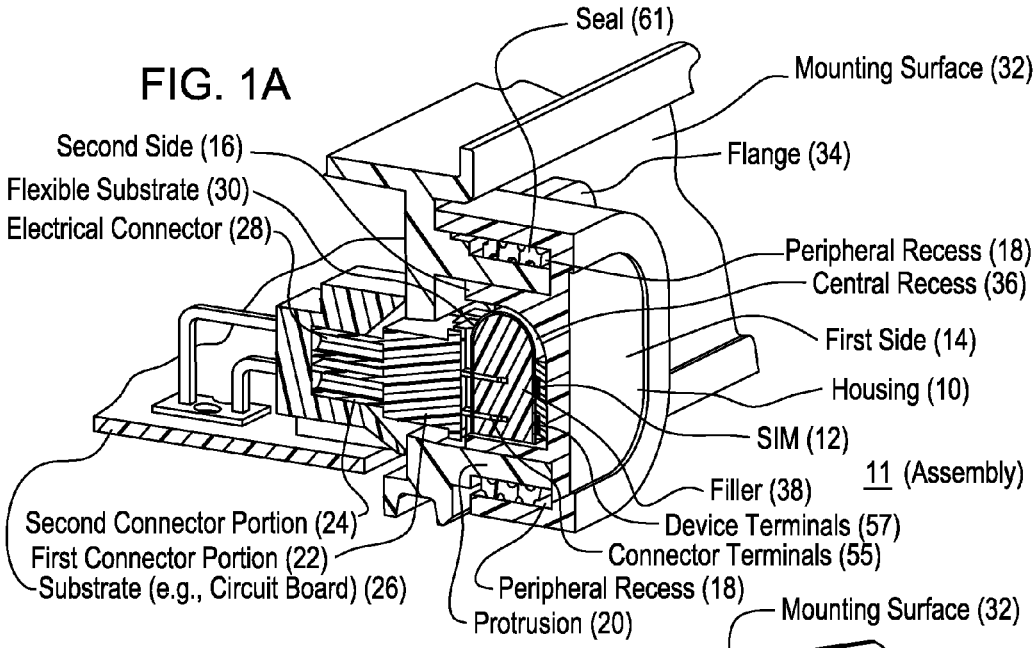
FIG. 1A is a cross sectional perspective view of a first embodiment of an assembly having a subscriber identification module.
Figure 1B:
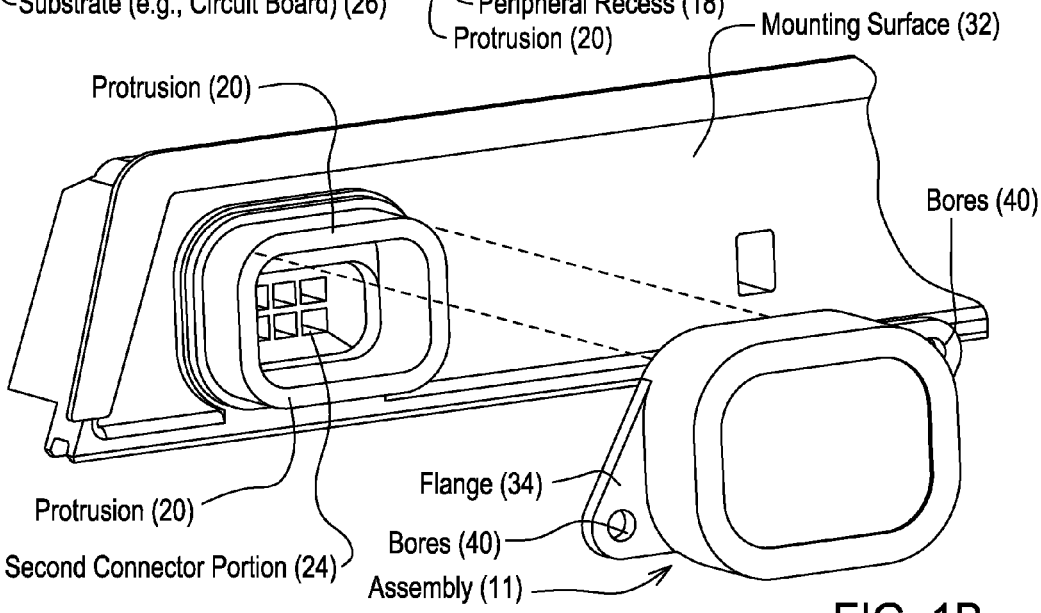
FIG. 1B is an exploded perspective view of the first embodiment of the assembly in accordance with FIG. 1A.
Figure 1C:
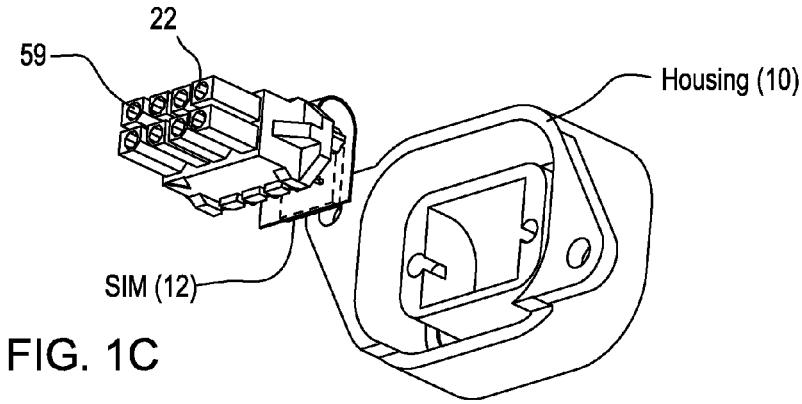
FIG. 1C is another exploded perspective view of the first embodiment of an assembly in accordance with FIG. 1A.

In accordance with a first embodiment of the assembly 11, FIG. 1A, FIG. 1B and FIG. 1C, illustrate a housing 10 having a first side 14 and a second side 16. A central recess 36 is disposed within the housing 10 on the second side 16. At least a portion of an electrical connector 28 is secured to the housing 10. The electrical connector 28 has connector terminals 55. A subscriber identification module (SIM) 12 is located within the housing 10 in the central recess 36. The subscriber identification module 12 has device terminals 57. A conductor or flexible substrate 30 electrically connects the connector terminals 55 to the device terminals 57. A protective filler 38 overlies or contacts the subscriber identification module 12 and at least part of the conductor or flexible substrate 30. For example, the protective filler 38 is located in or fills (completely or partially) what would otherwise be an air volume in the central recess 36.

The housing 10 includes a first side 14 and a second side 16 opposite the first side 14. In the second side 16, there is a central recess 36 and a peripheral recess 18 surrounding the central recess 36. The housing 10 further comprises a flange 34 for securing the housing 10 and the assembly 11 to a mounting surface 32, for example. The housing 10 secures a first connector portion 22 via a fastener, adhesive bonding, a press fit, or other mechanical retention mechanism (e.g., spring loaded ring or compression spring in a slot).

The electrical connector 28 comprises a first connector portion 22 that mates with a second connector portion 24. Each connector portion (22, 24) comprises a dielectric body and conductors having connector terminals 55 and mating terminals. The mating terminals 59 of the first connector portion 22 physically contact and electrically contact the mating terminals of the second connector portion 24 to allow the reliable transmission of electrical signals within the voltage and current ratings of the connector. In one embodiment, the electrical connector 28 supports a group of connector terminals for a subscriber identification module. For example, the group of connector terminals may comprise one or more of the following: a reset input terminal, a clock input terminal, a ground terminal, a clock output terminal, a data input terminal, a data output terminal, and power input. The input and output terminals may be arranged for serial input or output of digital signal levels, for example. Although FIG. 1A illustrates the second connector portion 24 as a surface mount device mounted on substrate 26 (e.g., a circuit board), different configurations of the connector and the second connector portion 24 may be used including surface mount, through-hole mounting, or otherwise.

The subscriber identification module (SIM 12) comprises an electronic device that is capable of communication with a wireless transceiver or terminal. In one embodiment, the SIM 12 comprises electronic memory (e.g., nonvolatile random access memory) and a card interface circuit (e.g., logic circuit) for wireless transceivers or terminals. For example, the SIM 12 may comprise a smart card that supports storage and retrieval of user data. The SIM 12 device may facilitate storage of user data, such as a user identifier, user location, user subscriber number (e.g., phone number) or user electronic address, network authorization data, user contact lists, stored text messages, user security data, and user passwords. The SIM 12 device may provide a personality to the associated electronics device based on the data stored within the SIM 12, where the personality tailors the electronics device to particular user preferences, particular user data, particular user settings, a particular selection of user programmable features, or particular functionality.

The SIM 12 is associated with a group of device terminals 57. For example, the group of device terminals 57 may comprise one or more of the following: a reset input terminal, a clock input terminal, a ground terminal, a clock output terminal, a data input terminal, a data output terminal, and power input.

In one embodiment, the SIM 12 is mounted on an interior wall of the central recess 36 and the volume between the SIM 12 and the first connector portion 22 is filled with a filler 38. The SIM 12 may be adhesively bonded or secured to the central recess 36 or on an interior wall of the central recess 36. The housing 10 provides a rigid shell that protects the SIM 12 from mechanical or environmental damage on one side, and the filler 38 dampens vibrations. In one exemplary embodiment, the filler 38 may comprise an elastomer, resilient polymer or other resilient material to dampen vibration. In another exemplary embodiment, the filler 38 may comprise ceramic particles in an elastomeric matrix or polymeric matrix to promote heat dissipation from the SIM 12 device.

Conductors 30 (e.g., of a flexible substrate) electrically connect the connector terminals 55 to the device terminals 57. In one embodiment, the conductors are formed integrally in or on a flexible dielectric substrate 30. The combination of the flexible dielectric substrate 30 and the conductors may comprise a flexible circuit board. A flexible circuit board generally comprises a flexible or pliable dielectric layer with one or more conductive traces (e.g., metallic traces) on one or more sides. In one embodiment, the flexible dielectric substrate 30 may be formed of polyamide or a similar polymer or plastic material. The conductive traces may be formed by electrodeposition, adhesively bonded metallic foil, adhesively bonded conductive wire, wire molded or buried in the substrate 30 by application of heat, pressure, or otherwise.

In an alternate embodiment, the conductor may comprise one or more of the following: wires, insulated wires, a cable, a multi-conductor cable, twisted pairs of wire, or the like that are adhesively bonded to the flexible dielectric substrate 30.

The conductors, the flexible substrate 30, or both support some movement of the SIM 12, where the SIM 12 is mounted, partially or entirely, in the filler 38 to provide vibration dampening and vibration reduction of the filler 38. Accordingly, the assembly 11 fosters reliability because the conductors or flexible substrate 30 or flexible circuit board is capable of movement in a manner that supports dampening of movement of the SIM 12 by the filler 38.

The assembly 11 is capable of mounting on a mounting surface 32 with a protrusion 20 that mates with or engages a peripheral recess 18 in the housing 10. In one embodiment, the protrusion 20 aligns the first connector portion 22 and the second connector portion 24 for interlocking engagement. A seal 61 may be placed in the peripheral recess 18 to hermetically seal the assembly 11 to the mounting surface 32 of an electronic device. The combination of the protrusion 20, the peripheral recess 18 and the seal 61 provide protection against the environment, including salt, fog, moisture, and vibration. In one embodiment, the seal 61 comprises an elastomer (e.g., an O-ring), a resilient polymer or resilient plastic material. The flange 34 supports attachment to the mounting surface 32 via one or more fasteners. For example, in one configuration, the housing 10 has one or more bores 40 that support attachment of the assembly 11 via one or more fasteners.

The manufacturing process for the assembly 11 of FIG. 1A may be carried out as follows. First, the electrical connector 28 or the first connector portion 22 is soldered, fused or electrically connected to one end of the flexible substrate 30 and then the SIM 12 is soldered, fused or electrically connected to the other end of the flexible substrate 30. Second, the SIM 12 may be glued or adhesively connected to an interior wall of the central recess 36. Third, the SIM 12 may be potted or the recess filled with a filler 38, as previously described.

FIG. 2A through FIG. 2E, inclusive, illustrate a second embodiment of an assembly 111. Like reference numbers in FIG. 1A through FIG. 2E, inclusive, indicate like elements.

Figure 2A:
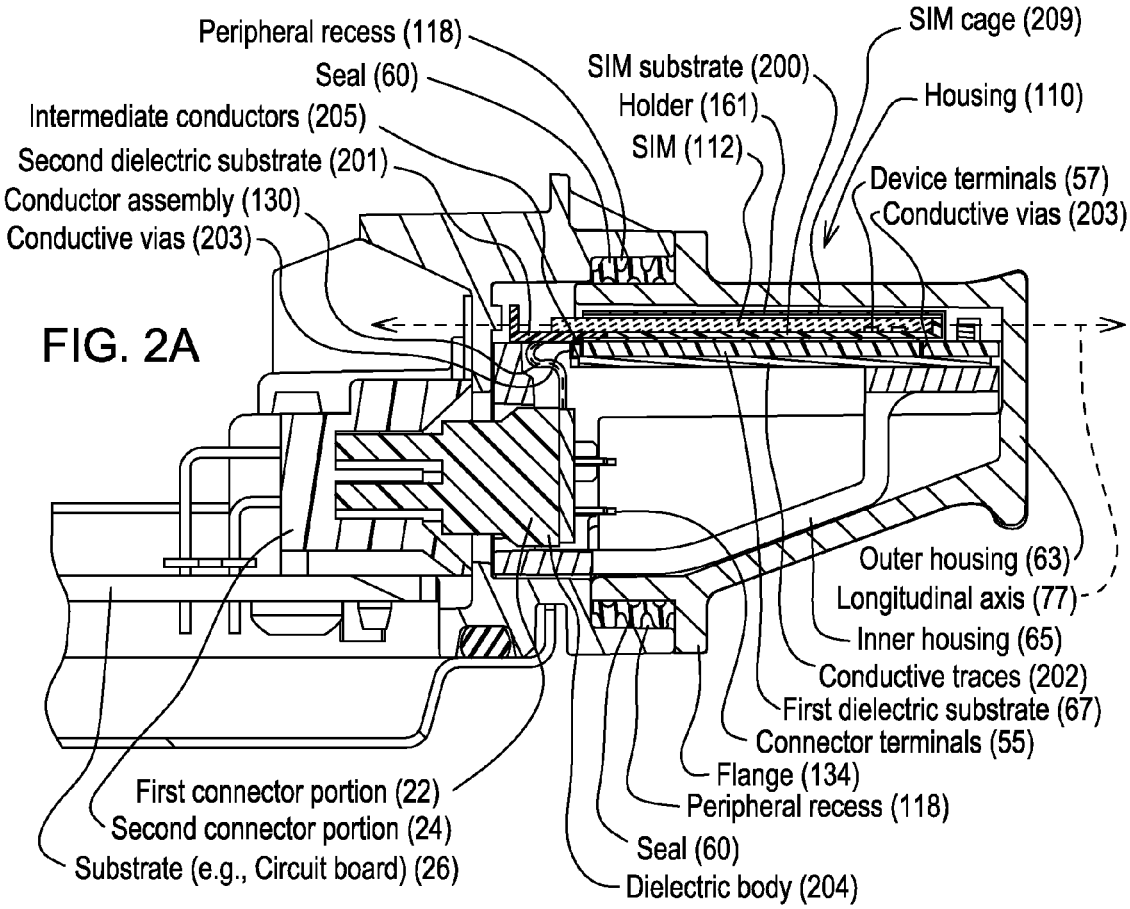
FIG. 2A is a cross sectional view of a second embodiment of an assembly having a subscriber identification module.
Figure 2B:
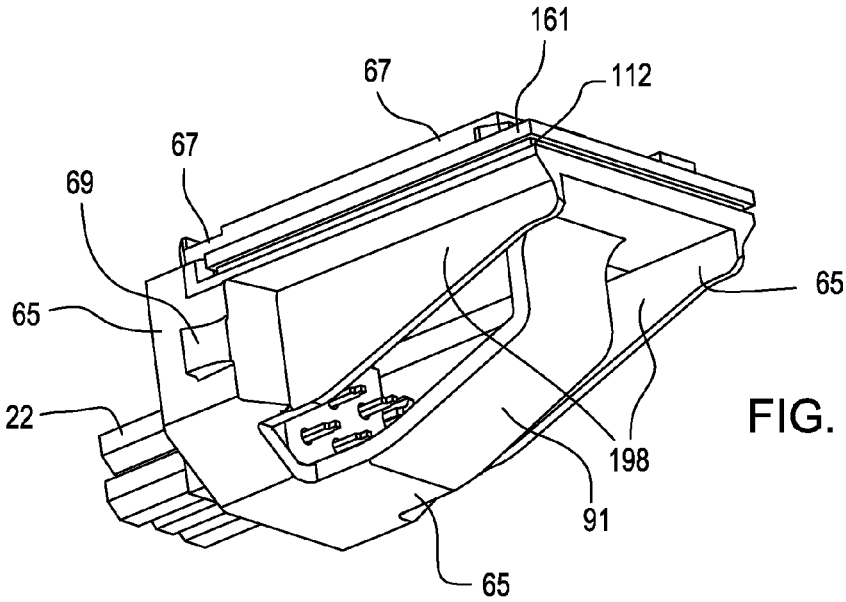
FIG. 2B is a perspective view of the second embodiment of the assembly in accordance with FIG. 2A.
Figure 2C:
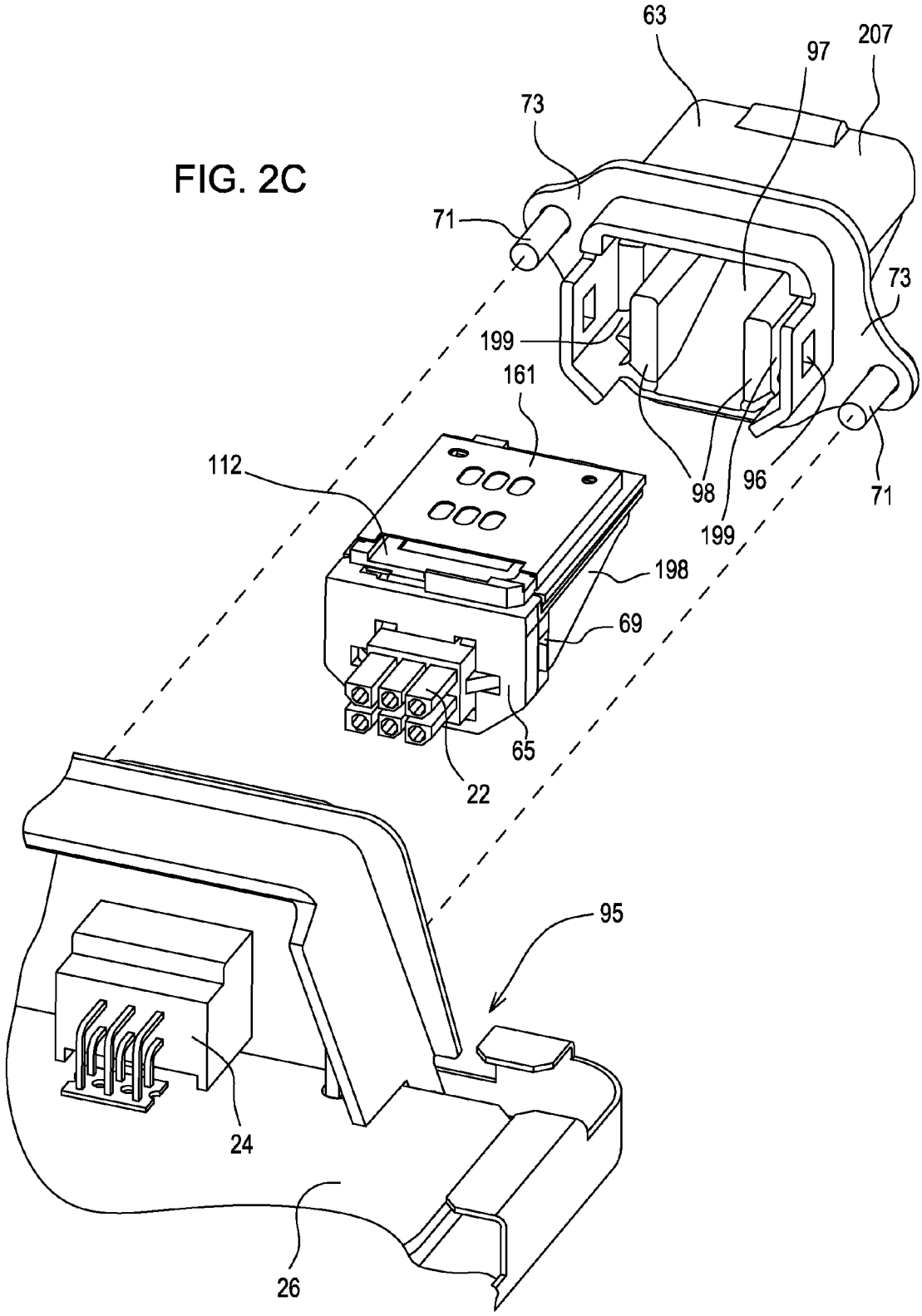
FIG. 2C is an exploded, perspective view of the second embodiment of the assembly in accordance with FIG. 2A.

In accordance with FIG. 2A through FIG. 2C, inclusive, an electrical assembly 111 (e.g., an electrical connector assembly) comprises a housing 110, where the housing has an inner housing 65 and a removable outer housing 63 removably connected to the inner housing 65. For example, the inner housing 65 may comprise one or more mounting rails 198 (in FIG. 2B) that engage or slip into corresponding recesses 199 (in FIG. 2C) within the outer housing assembly 63. The recesses 199 (in FIG. 2C) are bounded by secondary mounting rails 98 or walls within an interior 97 of the outer housing 63. A first connector portion 22 (in FIG. 2A) is secured to the inner housing 65. The first connector portion 22 comprises a dielectric body 204 and connector terminals 55 (in FIG. 2A). A subscriber identification module (SIM) 112 is supported by the inner housing 65. The subscriber identification module 112 has device terminals 57. A group of conductors or a conductor assembly 130 facilitates an electrical connection of the connector terminals 55 to the device terminals 57. As shown, a metal conductor (indicated with dashed lines) within an electrically insulating jacket is shown in FIG. 2A, although in practice multiple conductors (or more than one insulating jacket) may be present. Although the conductor assembly 130 may directly electrically connect the connector terminals 55 to the device terminals 57 in one configuration, in another configuration (as illustrated in FIG. 2A) the conductor assembly 130 may electrically connect connector terminals 55 to the device terminals 57 via an electrically conductive path (e.g., conductive metallic traces and conductive metallic vias) through one or more dielectric substrates (e.g., 200, 67 and 201). A holder 161 retains the subscriber identification module 112 with respect to the inner housing 65. For example, the holder 161 may removably or releasably retain the subscriber identification module 112.

In one embodiment, the outer housing 63 comprises a removable cover with a hollow central portion 97 for receiving and containing the subscriber identification module 112 mounted on the inner housing 65. In one configuration, the outer housing 63 comprises a retainer with openings 96 that engage corresponding protrusions 69 in the inner housing 65 to removably connect the outer housing 63 to the inner housing 65. The outer housing 63 may elastically deform (in the region of the openings 96) such that the sides or walls of the outer housing 63 pass over the protrusions 69 until they catch (or releasably lock) in one or more corresponding openings 96, slots or recesses in a wall of the outer housing 63. As shown in FIG. 2A, there is a peripheral recess 118 formed by the mating of the inner housing 65 and the outer housing 63, wherein the peripheral recess 118 has a seal 60 for preventing the ingress of moisture, debris or contamination, or foreign material. The flange 134 facilitates sealing of the inner housing 65 to the outer housing 63 (e.g., at a butt joint or a lap joint) to form a hermetic or moisture resistant seal in conjunction with the seal 60.

The outer housing 63 and inner housing 65 may be composed or formed of a plastic, a polymer, a fiber-reinforced plastic, a fiber-reinforced polymer, or another suitable electrically insulating material. However, in an alternate embodiment, the outer housing 63 and inner housing 65 may be composed of a metal or an alloy.

The removable outer housing 63 advantageously supports the convenient removal of the subscriber identification module 112. For example, the subscriber identification module 112 is capable of being replaced by removing the outer housing 63 and releasing the subscriber identification module 112 from the holder 161. Further, the removable outer housing 63 supports the ready and convenient replacement of the subscriber identification module 112 even while the electrical assembly 111 is in place and mounted to an electronic device 95 (in FIG. 2C and FIG. 2E) via a second flange 75 on the electrical device or electronic device 95.

The holder 161 may be configured or arranged such that the subscriber identification module 112 slides frontward (i.e., to the left in FIG. 2A or toward the first connector portion 22) or rearward (e.g., to the right in FIG. 2A or away from the first connector portion 22) upon release of the holder 161 to remove the subscriber identification module 112 from the holder 161. The holder 161 may hold the subscriber identification module 112 in place by compression, a press-fit, a resiliently biased member (e.g., an elastomer or a spring), or another suitable arrangement. As shown in FIG. 2A, a longitudinal axis 77 (indicated by the dashed line) of the subscriber identification module 112 is mounted generally parallel to and inwardly from an upper side or upper wall 207 of the outer housing 63. If the subscriber identification module 112 is generally polyhedral or shaped like a thin card, the face of the card (e.g., with the greatest surface area) generally lies in the horizontal plane when mounted as shown in FIG. 2E, for instance. In one embodiment, the holder 161 may comprise a hollow metal cage 209 with a SIM substrate 200 associated with an interior bottom portion of the holder 161.

In one arrangement, the first connector portion 22 comprises a plug or a socket. The second connector portion 24 engages the first connector portion 22 to support an electrical and mechanical connection between conductors with the connector portions (22, 24). The second connector portion 24 may be mounted on or associated with a substrate 26 (e.g., a circuit board) of an electronic or electrical device 95.

In one configuration, the device terminals 57 may comprise conductive pads. The conductors or conductor assembly 130 may be implemented in accordance with various configurations. In one configuration, the conductor assembly 130 is formed integrally in or on a flexible dielectric substrate. For example, the flexible dielectric substrate may comprise a polyimide substrate with metal conductive traces adhesively bonded thereto with a suitable adhesive or metal conductors embedded into a thermosetting or thermoplastic polyimide substrate in a thermal process. In another configuration, the conductors 130 comprise wires or a multi-wire cable with solid or stranded conductors and suitable insulating jackets. As illustrated, the conductor assembly 130 of the conductor assembly in FIG. 2A represents the side view of a wire, cable or flexible substrate.

The electrical connection between the device terminals 57 of subscriber identification module 112 and the connector terminals 55 is made via the conductors of the conductor assembly 130, among other components illustrated in FIG. 2A. The conductors of the conductor assembly 130 terminate at the connector terminals 55 and at intermediate conductors 205 associated with the second dielectric substrate 201. The intermediate conductors 205 support an electrically conductive path to the devices terminals of the SIM 112. The second dielectric substrate 201 and the first dielectric substrate 67 have intermediate conductors 205 that form an electrical connection when the inner housing 65 is joined with the outer housing 63. In one arrangement, the second dielectric substrate 201 is secured to the inner housing 65 and the intermediate conductors 205 comprise one or more of the following: conductive metal traces on a dielectric substrate, conductive metal vias or though-holes in a dielectric substrate, or conductive pads or terminals on the dielectric substrate.

In one configuration, the intermediate conductors 205 may further comprise an edge connector (e.g., board or card edge connector), such that the first dielectric substrate 67 and the second dielectric substrate 201 are mechanically connected by the edge connector and such that an electrical connection is made or supported between the subscriber identification module 200 and the connector terminals 55 of the first connector portion 22.

The first dielectric substrate 67 has conductive traces 202 and one or more conductive vias 203 to support one or more electrical connections between the intermediate conductors 205 and the device terminals 57 of the subscriber identification module 112. The conductive vias 203 may comprise metallic-plated, through-holes or conductively filed through-holes in the first dielectric substrate 67. The holder 161 and its SIM substrate 200 (e.g., dielectric with or without circuit traces, conductive vias, conductive pads, or other conductors) supports reliable electrical connections between the device terminals 57 of the subscriber identification module 112 and the intermediate conductors 205, consistent with avoiding the potential for short circuits, among other things. For example, the SIM substrate 200 may comprise dielectric layer, a metal conductive layer, and conductive vias to support reliable electrical connections between the device terminals 57 and the intermediate conductor 205.

FIG. 2B and FIG. 2C are perspective views of the second embodiment of the assembly in accordance with FIG. 2A. FIG. 2B illustrates the inner housing 65, which includes a protrusion 69 or projecting tab for engaging a corresponding opening 69 or recess in the outer housing 63. The inner housing 65 supports the first connector portion 22 or provides a framework for mounting the first connector portion 22. The top or upper portion of the inner housing 65 provides a platform, a frame, or a generally planar surface for mounting the holder 161 thereto or supporting the holder 161 thereon. The inner housing 65 has a central bracing member 91 for adding structural rigidity and resisting torsional stress that might otherwise damage the subscriber identification module 112 or electrical connections thereto during the removal of the outer housing 63 from the assembly 111 or otherwise. The mounting rails 198 are configured or adapted in size and shape to mate with the recesses 199 in the outer housing 63.

FIG. 2C illustrates an exploded, perspective view of the connector assembly of FIG. 2A. Like reference numbers in FIG. 2A and FIG. 2C indicate like elements. The inner housing 65 supports the first connector portion 22 and the holder 161. In turn, the holder 161 supports the subscriber identification module 112. The mounting rails 198 of the inner housing 65 engage or slide into corresponding recesses 199 in the outer housing 63, where the recesses 199 are bound by walls 98. One or more protrusions 69 of the inner housing 65 interlock with corresponding openings 96 in the outer housing 63. The second connector portion 24 is mounted on a substrate 26 of the electronic device 95.

FIG. 2D and FIG. 2E illustrates the first flange 73 which may be integrally formed as part of the outer housing 63. The first flange 73 has one or more openings for receiving fasteners 71 to mount the assembly to a mounting surface 132 of an electronic or electrical device 95. FIG. 2E is an exploded perspective view of the second embodiment of an assembly in accordance with FIG. 2A. FIG. 2E shows how the assembly mounts to a second flange 75 via the first flange 73 and fasteners 71. Further, FIG. 2E illustrates the alignment between the first connector portion 22 and the second connector portion 24 to form reliable electrical and mechanical connection between the subscriber identification module 112 and other circuitry of the electrical or electronic device via the connector formed by cooperation of the first connector portion 22 and the second connector portion 24, for example.

Having described the preferred embodiment, it will become apparent that various modifications can be made without departing from the scope of the invention as defined in the accompanying claims.

The following is claimed:

1. An electrical assembly comprising:

a housing comprising an inner housing and a removable outer housing removably connected to the inner housing;

a first connector portion secured to the inner housing, the first connector portion comprising a dielectric body and connector terminals;

a subscriber identification module supported by the inner housing, the subscriber identification module having device terminals;

a plurality of conductors for supporting an electrical connection of the connector terminals to the device terminals, wherein the conductors comprise wires or a multiwire cable; and a holder for retaining the subscriber identification module with respect to the inner housing.

2. The electrical assembly according to claim 1 wherein the outer housing comprises a removable cover with a hollow central portion for containing the subscriber identification module.

3. The electrical assembly according to claim 1 wherein the outer housing comprises a retainer that comprises openings that engage corresponding protrusions in the inner housing to removably connect the outer housing to the inner housing.

4. The electrical assembly according to claim 1 wherein the subscriber identification module is capable of being replaced by removing the outer housing and releasing the subscriber identification module from the holder.

5. The electrical assembly according to claim 4 wherein the subscriber identification module is capable of being replaced while the electrical assembly is in place and mounted to an electronic device via a mounting flange on the electrical assembly.

6. The electrical assembly according to claim 1 wherein a peripheral recess is formed by the mating of the inner housing and the outer housing, wherein the peripheral recess has a seal for preventing the ingress of moisture, debris, contamination, or foreign material.

7. The electrical assembly according to claim 1 wherein the subscriber identification module slides frontward toward the first connector portion upon release of the holder to remove the subscriber identification module from the holder.

8. The electrical assembly according to claim 1 wherein the subscriber identification module slides rearward away from the first connector portion upon release of the holder to remove the subscriber identification module from the holder.

9. The electrical assembly according to claim 1 wherein a longitudinal axis of the subscriber identification module is mounted generally parallel to and inwardly from an upper side or upper wall of the outer housing.

10. The assembly according to claim 1 wherein the first electrical connector portion comprises a plug or a socket.

11. The assembly according to claim 1 wherein the device terminals comprise conductive pads.

12. The assembly according to claim 1 wherein the subscriber identification module is slidably removable from the holder even when the electrical assembly is mounted to an electronic device.

13. An electrical assembly comprising:

a housing comprising an inner housing and a removable outer housing removably connected to the inner housing;

a first connector portion secured to the inner housing, the first connector portion comprising a dielectric body and connector terminals;

a subscriber identification module supported by the inner housing, the subscriber identification module having device terminals;

a plurality of conductors for supporting an electrical connection of the connector terminals to the device terminals;

a holder for retaining the subscriber identification module with respect to the inner housing; and a peripheral recess formed by the mating of the inner housing and the outer housing, wherein the peripheral recess has a seal for preventing the ingress of moisture, debris, contamination, or foreign material.

14. The electrical assembly according to claim 13 wherein the outer housing comprises a removable cover with a hollow central portion for containing the subscriber identification module.

15. The electrical assembly according to claim 13 wherein the outer housing comprises a retainer that comprises openings that engage corresponding protrusions in the inner housing to removably connect the outer housing to the inner housing.

16. The electrical assembly according to claim 13 wherein the subscriber identification module is capable of being replaced by removing the outer housing and releasing the subscriber identification module from the holder.

17. The electrical assembly according to claim 16 wherein the subscriber identification module is capable of being replaced while the electrical assembly is in place and mounted to an electronic device via a mounting flange on the electrical assembly.

18. The assembly according to claim 13 wherein the first electrical connector portion comprises a plug or a socket.

19. The assembly according to claim 13 wherein the device terminals comprise conductive pads.

20. The assembly according to claim 13 wherein the conductors are formed integrally in or on a flexible dielectric substrate.

* * * * *